United States Patent [19]

Osaki et al.

[11] Patent Number: 4,973,222

[45] Date of Patent: Nov. 27, 1990

[54] PUMP

[75] Inventors: Sannojo Osaki; Rokuheiji Satoh, both of Kanagawa, Japan

[73] Assignee: Nikuni Machinery Ind. Co., Ltd., Kanagawa, Japan

[21] Appl. No.: 386,287

[22] Filed: Jul. 27, 1989

[30] Foreign Application Priority Data

Aug. 4, 1988 [JP] Japan ..... 63-194748
Aug. 4, 1988 [JP] Japan ..... 63-194749

[51] Int. Cl.[5] ..... F04D 29/70

[52] U.S. Cl. ..... 415/121.2; 415/168.1; 417/423.9

[58] Field of Search ..... 415/55.1, 55.2, 55.3, 415/55.5, 170.1, 168.2, 169.1, 229, 230, 231, 168.1, 121.2; 417/423.9, 423.11

[56] References Cited

U.S. PATENT DOCUMENTS

| | | | |
|---|---|---|---|
| 1,397,273 | 11/1921 | Finn | 415/55.5 |
| 2,375,085 | 5/1945 | Curtis | 415/168.2 |
| 3,176,620 | 4/1965 | Shiley | 415/229 |
| 3,379,132 | 4/1968 | Wagner | 415/229 |
| 3,407,740 | 10/1968 | Samerdyke | 416/223 B |
| 4,384,725 | 5/1983 | Nenov | 277/53 |
| 4,477,223 | 10/1984 | Giroux | 415/168.2 |
| 4,722,663 | 2/1988 | Swearingen | 415/168.2 |

FOREIGN PATENT DOCUMENTS

| | | | |
|---|---|---|---|
| 711792 | 10/1941 | Fed. Rep. of Germany | 415/55.1 |
| 729453 | 11/1942 | Fed. Rep. of Germany | 415/55.2 |
| 1945979 | 8/1977 | Fed. Rep. of Germany | 415/55.1 |
| 2903064 | 8/1979 | Fed. Rep. of Germany | 415/168.2 |
| 97097 | 6/1982 | Japan | 415/55.2 |
| 271992 | 11/1987 | Japan | 415/55.1 |
| 120888 | 5/1988 | Japan | 415/55.1 |
| 312362 | 2/1956 | Switzerland | 415/168.2 |
| 606127 | 8/1948 | United Kingdom | 415/55.1 |

*Primary Examiner*—John T. Kwon
*Attorney, Agent, or Firm*—Nilles & Nilles

[57] ABSTRACT

A pump wherein a discharge port for discharging a working fluid in the vicinity of a mechanical seal to the outside of a casing is provided so as to be communicated to the portion of the outer circumferential surface of a rotary shaft between an impeller and the mechanical seal. The mechanical seal is fitted in the outer circumferential surface of the rotary shaft and adapted to seal the rotary shaft against the working fluid flowing from a fluid passage to the outer circumferential surface of the rotary shaft. The vane of the impeller is provided with a plurality of radially extending blades and recesses among the blades, the blades and the bottom portions of the recesses in the vane being joined together by curved surfaces.

2 Claims, 3 Drawing Sheets

PUMP

BACKGROUND OF THE INVENTION

1. Field of the Invention:

This invention relates to a pump adapted to generate lift in a working fluid by rotating an impeller in a fluid passage.

2. Description of the Prior Art:

A regenerative pump consists of a casing having therein an annular fluid passage communicated with a suction port and a discharge port of the casing, an impeller provided on the outer circumferential surface thereof with a vane fitted and adapted to be rotated in the fluid passage in the casing, a rotary shaft supported rotatably by the casing and having the impeller mounted unitarily thereon, and a mechanical seal fitted on the outer circumferential surface of the rotary shaft so as to prevent a working fluid, which flows in the fluid passage and contacts the outer circumferential surface of the rotary shaft, from leaking to the outside of the casing.

The vane of the impeller consists of a plurality of radially extending blades, and recesses provided among these blades.

When the rotary shaft is driven by a motor to rotate the impeller, the working fluid in the recesses in the vane of the impeller flows out from the outer circumferential portion of the vane into the fluid passage, and the working fluid in the fluid passage flows from a side portion of the vane into the recesses therein. The working fluid receives a pressure energy and velocity energy due to the centrifugal force generated by the rotating impeller, and the velocity energy is converted into pressure energy in the fluid passage. These operations are carried out repeatedly in the recesses in the vane of the impeller. Accordingly, the fluid pressure increases, and the working fluid is discharged from the discharge port.

The regenerative pump described above is constructed so that the impeller is rotated in a non-casing-contacting state, and the working fluid flows to the rotary shaft, on which the impeller is mounted, through the clearance between the impeller and the inner surface of the casing. Therefore, the leakage of the working fluid is prevented by the mechanical seal provided on the rotary shaft. This mechanical seal has a mechanical slide surface contacting the working fluid, and is necessarily subject to wear. The abrasion powder occurring as this mechanical slide surface is worn is mixed in the working fluid, and the abrasion powder-mixed working fluid is discharged through the fluid passage. Consequently, when the working fluid consisting, for example, of pure water which requires that no impurities mixed therein, such a conventional regenerative pump cannot be used.

In the conventional regenerative pump, further the vane of the impeller is formed so that the axis of a blade and the bottom portion of a recess in the vane extend at substantially right angles to cause an angular portion to occur between the blade and recess. Accordingly, the working fluid advancing from a side portion of the vane toward the outer circumferential portion thereof through the recesses does not flow smoothly at such angular portions. For example, when the working fluid consists of water, the microorganisms and impurities contained therein are deposited and accumulated on these angular portions. The same applies to a pump provided in its casing with a fluid passage having angular portions, i.e. a substantially square cross section.

SUMMARY OF THE INVENTION

The present invention has been developed with a view to solving these problems. An object of the present invention is to provide a pump capable of removing therefrom a working fluid containing abrasion powder separated from a mechanical seal and mixed in the working fluid, and of being used even when a working fluid, for example, water which requires prevention of impurities from being mixed therein is employed.

Another object of the present invention is to provide a pump capable of preventing impurities from being deposited on the inner surfaces of recesses in a vane and the inner surface of a fluid passage, by smoothing the flow of a working fluid and thereby improving the fluid cleaning effect.

The present invention is directed to a pump having a casing provided with a fluid passage therein, an impeller fitted rotatably in the fluid passage in the casing, a rotary shaft supported rotatably by the casing and provided with the impeller mounted unitarily thereon, and a mechanical seal fitted in the outer circumferential surface of the rotary shaft and adapted to seal the rotary shaft against a working fluid flowing from the fluid passage to the outer circumferential surface of the rotary shaft, characterized in that a discharge port for discharging the working fluid in the vicinity of the mechanical seal to the outside of the casing is provided so as to be in fluid communication with the portion of the outer circumferential surface of the rotary shaft between the impeller and the mechanical seal.

The present invention also provides a regenerative pump having a casing provided with an annular fluid passage therein, and an impeller provided on the outer circumferential surface thereof with a vane fitted in the fluid passage in the casing and adapted to be rotated in the fluid passage in the casing, characterized in that the fluid passage is formed so as to have substantially circular cross section, the vane of the impeller being provided with a plurality of radially extending blades and recesses among the blades, the blades and the bottom portions of the recesses in the vane being joined together by curved surfaces.

According to the present invention, the working fluid in which the abrasion powder from the mechanical seal is mixed is discharged to the outside of the casing through the discharge port.

The pump according to the present invention, in which the impeller with blades and the bottom portions of recesses in the vane connected together by curved surfaces, and the fluid passage having a substantially circular cross section are combined, enables the working fluid to flow more smoothly in the recesses and fluid passage, and the fluid cleaning effect of the working fluid to be improved in the recesses and fluid passage.

The above and other objects as well as advantageous features of the invention will become apparent from the following description of the preferred embodiment taken in conjunction with the accompanying drawings.

DESCRIPTION OF THE PREFERRED EMBODIMENT

The construction of an embodiment of the present invention will now be described with reference to the drawings.

Figure 3:
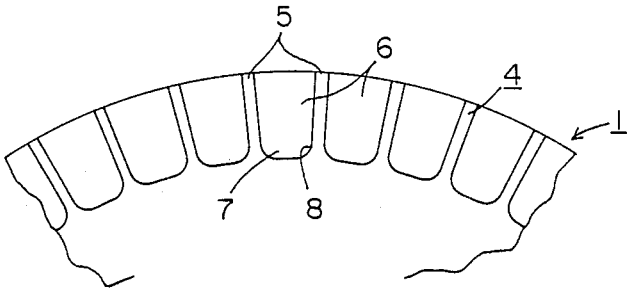
FIG. 3 is side elevation of a part of an impeller.
Figure 4:
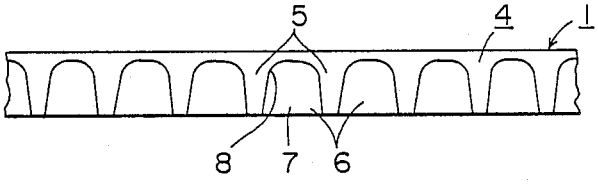
FIG. 4 is a plan view of the impeller of FIG. 3.
Figure 5:
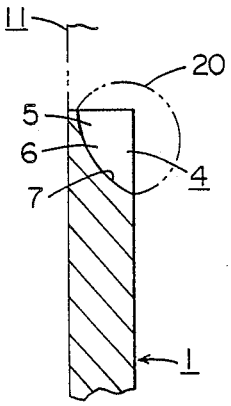
FIG. 5 is a sectional view of the impeller of FIG. 3.

Referring to the drawings, a reference numeral 1 denotes an impeller provided at the central portion thereof with a boss 3 having a threaded bore 2 opened at one side of the boss 3, and at the outer circumferential portion thereof with a vane 4. The vane 4 is provided as shown in FIGS. 3–5 with a plurality of radially extending blades 5, and recesses 6 formed among the blades 5 so as to be opened in the circumferential direction and one sideward direction of the vane 4, a bottom portion 7 of each of the recesses 6 having an arcuate surface, the bottom portion 7 and the blades 5 on both sides thereof being joined together by curved surfaces 8.

A reference numeral 11 denotes a casing, to one side of which a support 12 is attached, to the other side of which a cover 14 tightened by bolts (not shown) is fixed tightly via a packing 13. A rotary shaft 16 is supported rotatably by the support 12 via a bearing 15. One end portion of the rotary shaft 16 projects from an end surface of the support 12 to be connected to a motor (not shown), while the other end portion thereof projects into an inner space 17 in the casing 11 with a threaded section 18 at this end portion engaged with the threaded bore 2 in the impeller 1 so as to be connected firmly thereto.

Figure 1:
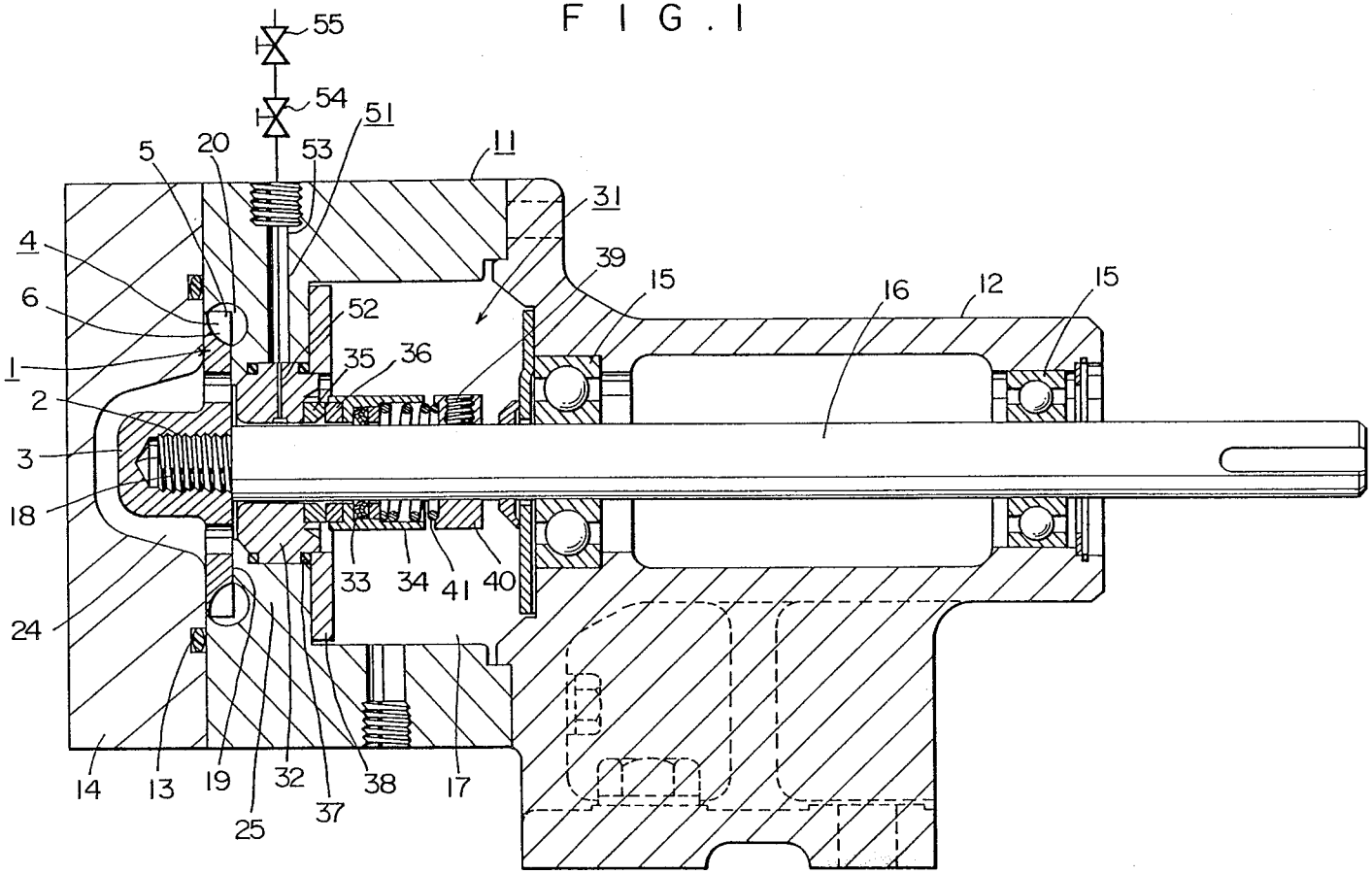
FIG. 1 is a sectional view of an embodiment of a regenerative pump according to the present invention.
Figure 2:
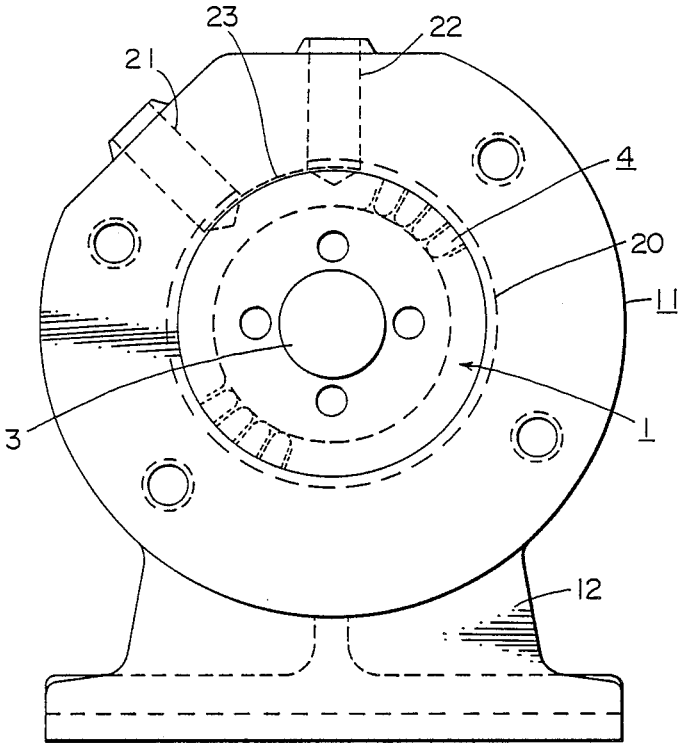
FIG. 2 is a side elevation of the embodiment with a cover removed.

The side surface of the casing 11 which is opposed to the cover 14 is provided with an annular recess 19 in which the impeller 1 is rotatably fitted, and a fluid passage 20 is provided at the outer circumferential portion of the recess 19. This fluid passage 20 is formed annularly to a substantially circular cross section. As shown in FIG. 2, a suction port 21 and a discharge port 22 are communicated with this fluid passage 20, and an isolator 23 for shutting off the portion of the fluid passage 20 which is on the side of the suction port 21 from the portion of the fluid passage 20 which is on the side of the discharge port 22 is provided between the suction port 21 and discharge port 22.

The surface of the cover 14 which is opposed to the casing 11 is provided with a recess 24 in which the boss 3 of the impeller 1 is inserted.

A mechanical seal 31 is mounted on the outer surface of the rotary shaft 16 which is in the casing 11, and it is fitted firmly in the inner circumferential part of a stepped portion 25 of the casing 11 which is between the inner space 17 and recess 19 therein. The mechanical seal 31 is provided with an annular fixed side member 32 in which the rotary shaft 16 is fitted rotatably, and a tubular rotary side member 34 having a packing 33 fitted closely around the outer circumferential surface of the rotary shaft 16, and these members 32, 34 are joined to each other via slide members 35, 36 provided thereon. The fixed side member 32 is fitted closely in the inner circumferential surface of the stepped portion 25 via a packing 37 and held firmly with a fastening plate 38 fixed tightly to the side surface of the stepped portion 25 by bolts (not shown). A spring 41 is provided between the rotary side member 34 and a fastening ring 40 fixed to the portion of the outer circumferential surface of the rotary shaft 16 which is adjacent to the rotary side member 34 by a screw 39, and the slide member 35, 36 are urged toward and fixed under pressure to the fixed side member 32 by this spring 41.

The fixed side member 32 of the mechanical seal 31 and casing 11 are provided with a discharge port 51 which communicates the circumferential surface of the rotary shaft 16 with the exterior of the casing 11. This discharge port 51 consists of a port 52 extending between the inner and outer sides of the fixed side member 32, and a port 53 extending between the inner and outer sides of the casing 11, and a needle valve 54 and a stop valve 55 are connected to this discharge port 51.

The operation of the present invention will now be described.

When the rotary shaft 16 is driven by the motor to rotate the impeller 1, the working fluid in the recesses 6 in the vane of the impeller flows out from the outer circumferential portion of the vane into the fluid passage 20, and a flow of the working fluid from the fluid passage 20 into the recesses 6 through the side portion of the vane occurs. Owing to the centrifugal force of the rotating impeller 1, the working fluid receives pressure energy and velocity energy, and the velocity energy is converted into pressure energy in the fluid passage 20. Such operations are carried out repeatedly in the recesses 6 in the vane of the impeller 1. Consequently, the fluid pressure increases, and the working fluid is discharged through the discharge port 22.

The regenerative pump is constructed so that the impeller 1 is rotated not in contact with the casing 11, and the working fluid flows to the rotary shaft 16, on which the impeller 1 is mounted, through a clearance between the impeller 1 and casing 11. However, the leakage of the working fluid is prevented by the mechanical seal 31 provided on the rotary shaft 16. Since the rotary side member 34 of this mechanical seal 31 is rotated with the rotary shaft 16, the slide member 36 for the rotary side member 34 is slidingly moved with respect to the slide member 35 for the fixed side member 32. Therefore, abrasion necessarily occurs on the slide surfaces of the slide members 35, 36 of the mechanical seal 31, and abrasion powder occurring due to this abrasion is mixed in the working fluid.

If the stop valve 55 provided in the discharge port 51 is opened at this time, the abrasion powder is discharged to the outside through the discharge port 51 with the working fluid which flows while turning around the circumference of the rotary shaft 16 in accordance with the rotation thereof. The abrasion powder-mixed working fluid does not flow into the fluid passage 20, nor is it therefore discharged from the discharge port 22. Accordingly, this pump can also be applied to a working fluid consisting, for example, of water which requires prevention of impurities from being mixed therein.

The discharge rate of the working fluid sent out to the outside through the discharge port 51 can be regulated by increasing or decreasing the degree of opening of the needle valve 54, and the discharging of the working fluid can be stopped by closing the stop valve 55.

This discharge port 51 can be applied not only to a mechanical seal portion of a regenerative pump but also to that of a pump of some other construction.

The working fluid flowing in the recesses 6 in the vane of the impeller 1 from one side of the vane toward the outer circumference of the vane advances smoothly and has an excellent fluid cleaning effect since the bottom portion 7 of each of the recess and blades 5 on both sides thereof are joined together by curved surfaces 8 so that the joint portions of the recess and adjacent blades 5 have no angular parts. Accordingly, even when the working fluid in use consists of water, the microorganisms and impurities contained in the water are not deposited and accumulated. Similarly, since the interior of the fluid passage 20 also has a substantially circular cross section, the working fluid therein flows smoothly and has an excellent fluid cleaning effect.

Moreover, since the impeller 1 having arcuately extending bottom portions 7 of recesses and curved surfaces 8, and the fluid passage 20 having a substantially circular cross section are combined, the flow of the working fluid becomes more smooth. This enables a current loss of the working fluid to be minimized, and a high operation efficiency to be obtained.

The bottom portion 7 of each of the recesses 6 in the impeller and the adjacent curved surfaces may be formed to a semicircular shape the diameter of which is equal to the width of a recess 6.

According to the present invention, the working fluid in which the abrasion powder from the mechanical seal is mixed can be discharged to the outer side of the casing through the discharge port, and the present invention can also be applied to even a working fluid, for example, water which requires to prevent impurities from being mixed therein.

According to the present invention, in which the impeller with the blades and the bottom portions of recesses in the vane connected together by curved surfaces, and the fluid passage having a substantially circular cross section are combined, enables the working fluid to flow more smoothly in the recesses and fluid passage, and the fluid cleaning effect of the working fluid to be improved in the recesses and fluid passage. The present invention can reliably prevent, for example, the impurities contained in the working fluid from being deposited and accumulated on the surfaces of the recesses in the vane and the inner surfaces of the fluid passage.

What is claimed is:

1. In a pump having a casing provided with a fluid passage therein, an impeller fitted rotatably in the fluid passage in the casing, a rotary shaft having an outer circumferential surface supported rotatably by the casing, the impeller mounted on said shaft for rotation in the fluid passage to establish a working fluid circulation system through the fluid passage when said pump is in operation, and a mechanical seal fitted on the outer circumferential surface of the rotary shaft and adapted to seal the rotary shaft against a portion of the working fluid flowing from the fluid passage along the outer circumferential surface of the rotary shaft to the exterior of the casing, the improvement comprising a working fluid discharge port in the casing in fluid communication between a portion of the outer circumferential surface of the rotary shaft that is in the vicinity of the mechanical seal and the exterior of the casing, said discharge port discharging that portion of the working fluid in the working fluid circulation system that flows in the vicinity of the mechanical seal in order to carry abrasion material generated by operation of the seal away from the remaining working fluid in the pump circulating system.

2. In a regenerative pump having a casing provided with an annular fluid passage therein; an impeller having an axially extending circumferential periphery fitted rotatably in the fluid passage in the casing; a rotary shaft having an outer circumferential surface and supported rotatably by the casing, the impeller mounted on the shaft for rotation in the fluid passage to establish a working fluid circulation system through said fluid passage when said pump is in operation; and a mechanical seal fitted on the outer circumferential surface of the rotary shaft and adapted to seal the rotary shaft against a portion of the working fluid flowing from the fluid passage along the outer circumferential surface of the rotary shaft to the exterior of the casing; the improvement comprising a working fluid discharge port in the casing in fluid communication between a portion of the outer circumferential surface of the rotary shaft that is in the vicinity of the mechanical seal and the exterior of the casing, said discharge port discharging that portion of the working fluid in the working fluid circulation system that flows in the vicinity of the mechanical seal in order to carry abrasive material generated by operation of the seal away from the remaining working fluid in the working fluid circulation system, and the annular fluid passage having a substantially circular cross section throughout its annular extent, the vane of the impeller having a plurality of radially extending blades projecting into said annular fluid passage and separated by recesses in the vane between the blades, the vane recesses each having a bottom area that extends between spaced adjacent blades with the bottom area of each recess and the blades adjacent thereto being joined together by curved surfaces.

* * * * *